US006263181B1

(12) United States Patent
Vaughan et al.

(10) Patent No.: US 6,263,181 B1
(45) Date of Patent: Jul. 17, 2001

(54) ELECTROSTATOGRAPHIC REPRODUCTION MACHINE INCLUDING A DUAL FUNCTION FUSING BELT DESKEWING AND OILING ASSEMBLY

(75) Inventors: Derek E. Vaughan, St. Albans (GB); Donald M. Bott, Rochester, NY (US); Anthony S. Condello, Webster, NY (US); Mark S. Amico, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/565,926

(22) Filed: May 5, 2000

Related U.S. Application Data

(60) Provisional application No. 60/146,362, filed on Aug. 2, 1999.

(51) Int. Cl.[7] ..... G03G 15/20

(52) U.S. Cl. ..... 399/325; 399/329

(58) Field of Search ..... 399/325, 326, 399/327, 329, 165; 219/216

(56) References Cited

U.S. PATENT DOCUMENTS 5,250,998 10/1993 Ueda et al. ..... 355/285
5,465,146 11/1995 Higashi et al. ..... 355/285
6,088,558 * 7/2000 Yamada et al. ..... 399/329 X

FOREIGN PATENT DOCUMENTS 10-32281 * 2/1989 (JP) .

* cited by examiner

*Primary Examiner*—Quana M. Grainger
(74) *Attorney, Agent, or Firm*—Tallam Nguti

(57) ABSTRACT

An electrostatographic reproduction machine including a contact belt fusing apparatus for fusing copy sheets without belt skew defects. The fusing apparatus includes an endless fusing belt having an external fusing surface defining a path of movement and a plurality of support rollers for supporting and moving the endless fusing belt along the path of movement. The endless fusing belt as supported has a preferred fusing position properly aligned on the plurality of support rollers. The fusing apparatus includes a pressure roller forming a fusing nip with the external fusing surface of the endless fusing belt for contacting and moving toner image carrying sheets therethrough. Importantly, the fusing apparatus also includes a dual function belt deskewing and oiling assembly for oiling the external fusing surface of the endless fusing belt and deskewing the fusing belt from a sensed skewed position to the preferred fusing position. The dual function belt deskewing and oiling assembly includes an oiling roller for contacting and oiling the fusing belt, and skewing means for skewing the oiling roller to controllably move the endless fusing belt in a deskewing manner from a sensed skewed position to the preferred fusing position, thereby preventing belt skew defects on fused copies.

8 Claims, 3 Drawing Sheets

ELECTROSTATOGRAPHIC REPRODUCTION MACHINE INCLUDING A DUAL FUNCTION FUSING BELT DESKEWING AND OILING ASSEMBLY

RELATED CASES

This Application is based on a Provisional Application No. 60/146,362 filed Aug. 2, 1999.

This Application is related to U.S. application Ser. No. 60/146,387 entitled ELECTROSTATOGRAPHIC REPRODUCTION MACHINE HAVING A FUSING BELT POSITION CHANGING MECHANISM; and to U.S. application Ser. No. 60/146,372 entitled "ELECTROSTATOGRAPHIC REPRODUCTION MACHINE INCLUDING A DUAL FUNCTION FUSING BELT DESKEWING AND HEATING ASSEMBLY" both filed on the same date herewith; and each having at least one common inventor.

BACKGROUND OF THE INVENTION

This invention relates generally to electrostatographic reproduction machines, and more particularly to such a machine including a contact belt fusing apparatus having a dual function fusing belt oiling and deskewing assembly for oiling and deskewing the fusing belt so as to fuse copy sheets without belt skew defects.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rollers with the toner image contacting the heated fuser roller to thereby effect heating of the toner images within the nip. In a Nip Forming Fuser Roller (NFFR), the heated fuser roller is provided with a layer or layers that are deformable by a harder pressure roller when the two rollers are pressure engaged. The length of the nip determines the dwell time or time that the toner particles remain in contact with the surface of the heated roll.

The heated fuser roller is usually the roller that contacts the toner images on a substrate such as plain paper. In any event, the roller contacting the toner images is usually provided with an abhesive (low surface energy) material for preventing toner offset to the fuser member. Three materials which are commonly used for such purposes are PFA, Viton™ and silicone rubber.

Roller fusers work very well for fusing color images at low speeds since the required process conditions such as temperature, pressure and dwell can easily be achieved. When process speeds approach 100 pages per minute (ppm) roller fusing performance starts to falter. At such higher speeds, dwell must remain constant which necessitates an increase in nip width. Increasing nip width can be accomplished most readily by either increasing the fuser roller (FR) rubber thickness and/or the outside diameter of the roll. Each of these solutions reach their limit at about 100 ppm. Specifically, the rubber thickness is limited by the maximum temperature the rubber can withstand and the thermal gradient across the elastomer layer. The roller size becomes a critical issue for reasons of space, weight, cost, & stripping.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,250,998 granted to Ueda et al on Oct. 5, 1993 discloses a toner image fixing device wherein there is provided an endless belt looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller.

U.S. Pat. No. 5,465,146 granted to Hgashi et al on Nov. 7, 1995 relates to a fixing device to be used in electrophotographic apparatus for providing a clear fixed image with no offset with use of no oil or the least amount of oil, wherein an endless fixing belt provided with a metal body having a release thin film thereon is stretched between a fixing roller having a elastic surface and a oiling roller, a pressing roller is arranged to press the surface of the elastic fixing roller upwardly from the lowerheating side thereof through the fixing belt to form a nip portion between the fixing belt and the pressing roller, a guide plate for unfixed image carrying support member is provided underneath the fixing belt, between the heating roller and the nip portion, to form substantially a linear heating path between the guide plate and the fixing belt, and the metal body of the fixing belt has a heat capacity per $cm^2$ within the range of 0.001 to 0.02 cal/° C.

A problem encountered with heat and pressure belt fusers or fusing apparatus is undesirable belt wandering or skew which results from manufacturing, assembly and operating tolerances. Such skew or wander tends to cause visible belt wander or belt skew defects on fused copies. There is therefore a need to provide effective and economical heat and pressure belt fusers that fuse image copies without belt wander defects.

SUMMARY OF THE INVENTION

According to the present invention, there is provided an electrostatographic reproduction machine including a contact belt fusing apparatus for fusing copy sheets without belt skew defects. The fusing apparatus includes an endless fusing belt having an external fusing surface defining a path of movement and a plurality of support rollers for supporting and moving the endless fusing belt along the path of movement. The plurality of rollers include a heating roller having a heat source for heating the endless fusing belt. The endless fusing belt as supported has a preferred fusing position properly aligned on the plurality of support rollers, as well as may have undesirable skewed positions from the preferred fusing position. The fusing apparatus also includes a pressure roller forming a fusing nip with the external fusing surface of the endless fusing belt for contacting and moving toner image carrying sheets therethrough. Importantly, the fusing apparatus further includes a dual function belt deskewing and oiling assembly for oiling the external fusing surface of the endless fusing belt and for deskewing the fusing belt from a sensed skewed position to the preferred fusing position. The dual function belt deskewing and oiling assembly includes an oiling roller for contacting and oiling the fusing belt, and skewing means for skewing the oiling roller to controllably move the endless fusing belt in a deskewing manner from a sensed skewed position to the preferred fusing position, thereby preventing belt skew defects on fused copies.

DETAILED DESCRIPTION OF THE INVENTION

Figure 1:
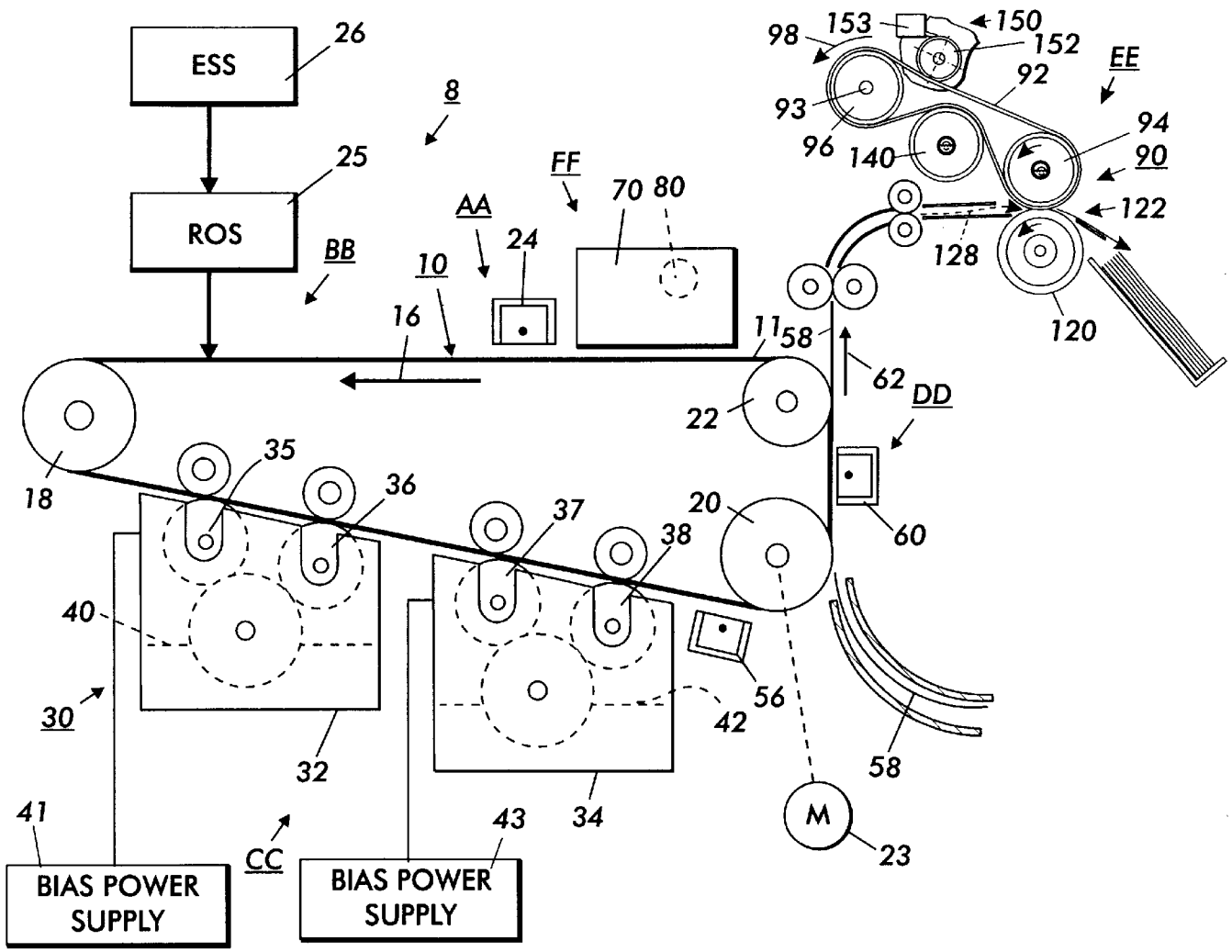
FIG. 1 is a vertical schematic of an electrostatographic reproduction machine including a belt fusing apparatus and the dual function fusing belt deskewing assembly according to the present invention.

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Referring now to the drawings, where the showings are for the purpose of describing a preferred embodiment of the invention and not for limiting same, and where the various processing stations employed in a reproduction machine as illustrated in FIG. 1, will be described only briefly.

Referring now to FIG. 1, a reproduction machine, in which the present invention finds advantageous use, utilizes a charge retentive image bearing member in the form of a photoconductive belt 10 consisting of a photoconductive surface 11 and an electrically conductive, light transmissive substrate mounted for movement past a charging station AA, an exposure station BB, developer stations CC, transfer station DD, fusing station EE and cleaning station FF. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Roller 20 is coupled to motor 23 by suitable means such as a belt drive. Motor 23 rotates roller 20 to advance belt 10 in the direction of arrow 16.

As can be seen by further reference to FIG. 1, initially successive portions of belt 10 pass through charging station AA. At charging station AA, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station BB. At exposure station BB, the uniformly charged photoreceptor or charge retentive surface 10 is exposed to a laser based input and/or output scanning device 25 which, as controlled by controller or ESS 26, causes the charge retentive surface to be discharged in accordance with the output from the scanning device. The ESS 26, for example, is the main multi-tasking processor for operating and controlling all of the other machine subsystems and printing operations, including aspects of the present invention. The scanning device is a three level laser Raster Output Scanner (ROS). The resulting photoreceptor contains both charged-area images and discharged-area images.

At development station CC, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pretransfer corona discharge member 56 is provided to condition the toner for effective transfer to a substrate using corona discharge of a desired polarity, either negative or positive.

Sheets of substrate or support material 58 are advanced to transfer station DD from a supply tray, not shown. Sheets are fed from the tray by a sheet feeder, also not shown, and advanced to transfer station DD through a corona charging device 60. After transfer, the sheet continues to move in the direction of arrow 62 to fusing station EE.

Figure 2:
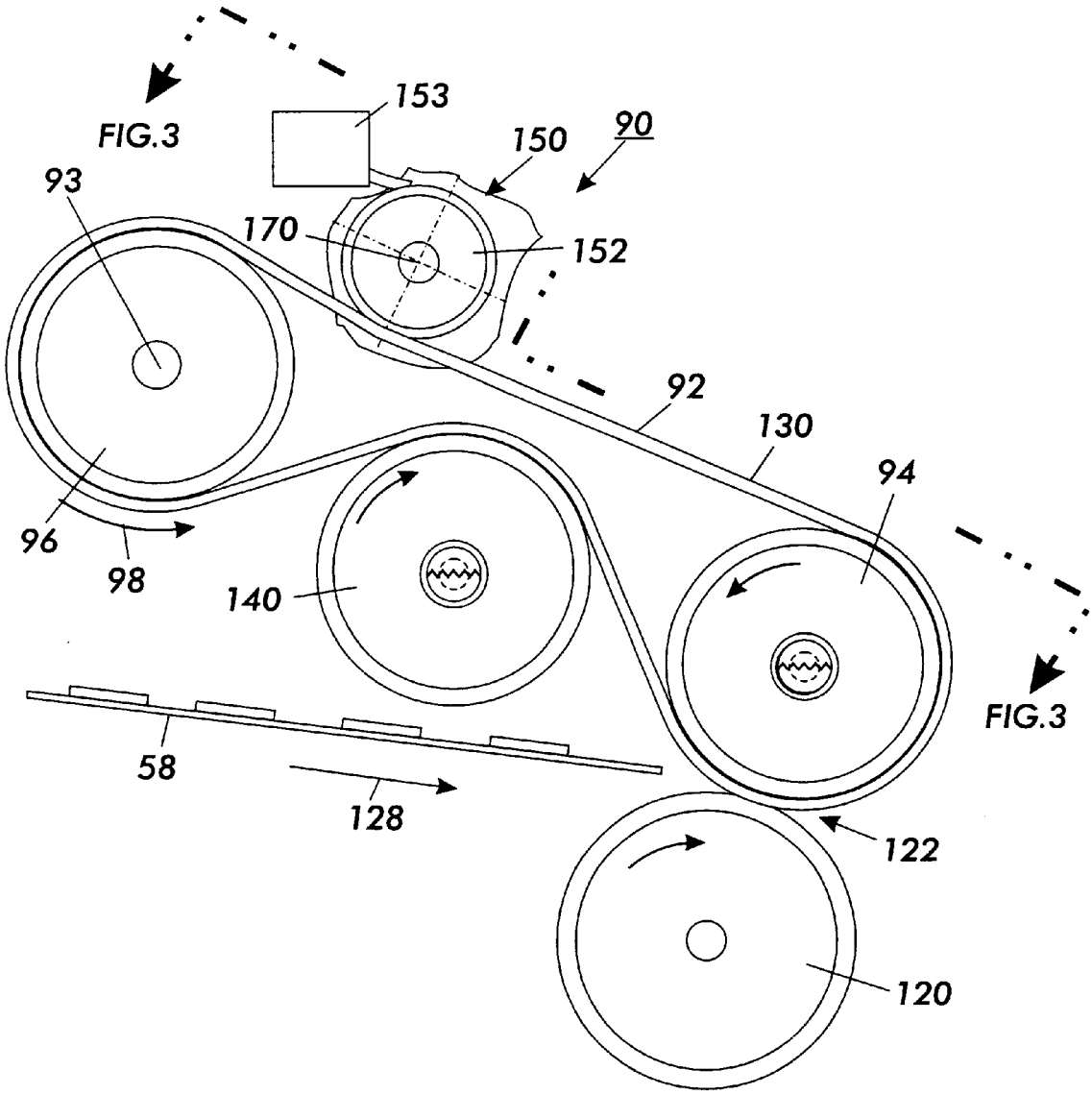
FIG. 2 is an end view schematic of the belt fusing apparatus and the dual function fusing belt deskewing assembly according to the present invention.
Figure 3:
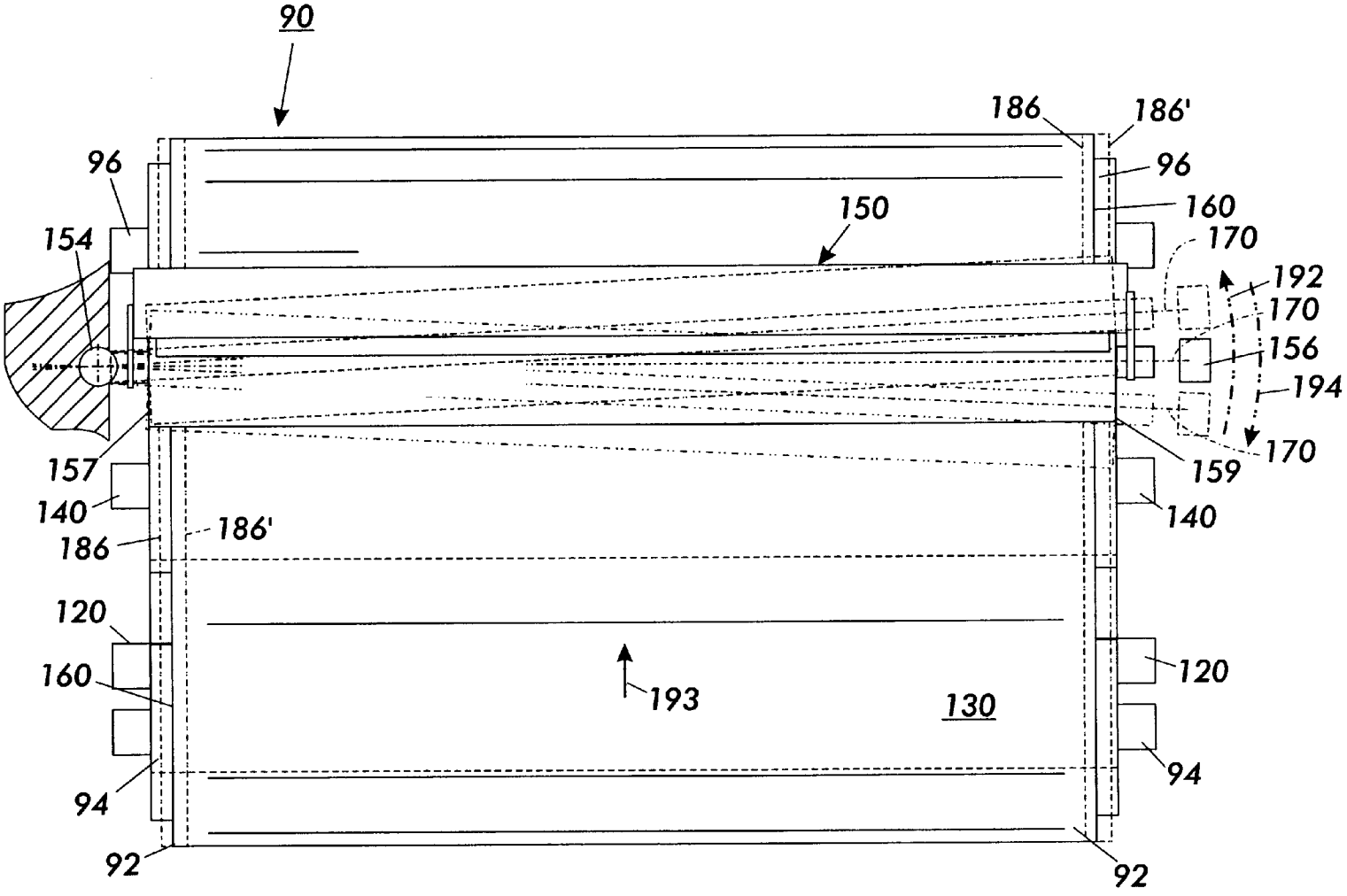
FIG. 3 is a top view schematic of the belt fusing apparatus and the dual function fusing belt deskewing assembly showing a number of different axial positions of the belt relative to the rollers in accordance with the present invention.

Referring now to FIGS. 1–3, fusing station EE includes a contact belt fusing apparatus 90. The fusing apparatus 90 includes an endless fusing belt 92 that is supported for movement in an endless path by a plurality of rollers (as shown) having parallel axes including 93. The plurality of rollers include a pair of rollers 94 and 96 which are tension belt engageable support rollers. The roller 94 can be a drive roller and the roller 96 is an idler roller cooperating with the roller 94 to support and move the belt 92 in and endless loop or path of movement in the direction of the arrow 98. As shown in FIGS. 2–3, the fusing belt 92 as supported has a preferred, centered fusing position 160 that is properly aligned on the plurality of support rollers, as well as ordinarily would have an occasional undesirable sensed skewed position 186, 186' that is skewed relative to the preferred, centered fusing position 160.

A pressure roller 120 is mounted externally to the belt 92 for pressure engagement with the belt 92 against the roller 94 such that the belt 92 is sandwiched therebetween in order to form a fusing nip 122. Imaged substrates such as the sheet of plain paper 58 carrying toner images move in the direction of the arrow 128 pass through the nip 122 with the toner images contacting an outer surface 130 of the belt 92. The fusing nip 122 comprises a single nip, in that, the section of belt contacted by the roller 94 is coextensive with the opposite side of the belt contacted by pressure roller 120. In other words, neither of the rollers 94 and 120 contact a section of the belt not contacted by the other of these two rolls. A single nip insures a single nip velocity through the entire nip.

The fusing surface 130 of the belt 92 is elevated to fusing temperature by means of an internally heated roller 140 having a conventional quartz heater 142 disposed internally thereof. The roller 140 comprises a relatively thin (0.022 to 0.2 inch) walled metal structure chosen for its good heat conducting properties. To this end the roller 140 may be fabricated from aluminum or steel.

The belt 92 preferably comprises silicone rubber of the type conventionally utilized in roller fusers. The thickness of the belt 92 is in the order of 0.006 to 0.925 inch. The deformable belt 92 provides the same function as the deformable layer of a Nip Forming Fuser Roller (NFFR), that is, it is self stripping. Also, smaller nip pressure rollers can be used in this belt fuser since the deformable belt, not the roller diameter, is the major contributor for generating the nip required for higher speed fixing of toner images. Smaller roller diameters also equate to more reliable stripping.

Importantly, the contact belt fusing apparatus 90 includes a dual function belt deskewing and oiling assembly 150 for oiling the external fusing surface 130 of the endless fusing belt, and for deskewing the fusing belt from the sensed undesirable skewed position 186, 186' to the preferred fusing position 160, thereby preventing belt skew defects on fused copies. The dual function belt deskewing and oiling assembly 150 as shown includes a rotatable oiling roller 152, mounted for receiving oil or release agent from a supply source 153 thereof, and for contacting as well as oiling the fusing belt 92. The oiling roller 152 has a first end 157, a second end 159, and an axis 170. The dual function belt deskewing and oiling assembly 150 also includes a pivot means 154 connected to the first end 157 of the roller 152, and skewing means 156 connected to the other and opposite end 159 thereof, for skewing the oiling roller 152 to a suitable angle. Skewing the roller 152 as such controllably moves the endless fusing belt 92 in a deskewing manner from the sensed skewed position 186, 186' to the preferred fusing position 160. As shown, the skewing means 156 skews the roller 152 by moving it angularly relative to the parallel axes (e.g. 93) of one of the plurality of rollers. The pivot means 154 thus enables pivoting of the oiling roller 152 when being skewed.

As pointed out above, ordinarily, rotating belt fusers or fusing apparatus suffer from undesirable belt wandering or skew due to manufacturing, assembly, and operating, tolerances. Such belt skew or wander if uncorrected results in visible belt wander or belt skew defects on fused copies. Correcting for such defects usually requires keeping the belt centered. In accordance with the present invention, oiling roller 152 is used for performing the dual functions of deskewing or centering the belt 92 as such, as well as for oiling the external surface of the roller 152. This is achieved by making the axis 170 of the oiling roll 140 skewable in a first direction 192 relative to a normal or perpendicular to the process direction 193 of belt movement.

The roller 152 can also be skewed in a second and opposite direction 194 (so that its axis as located is 170') for moving the belt 92 in the opposite direction, towards its second end 159. The belt 92 can thus also be moved from a sensed skewed position 186, 186' to its preferred, or centered fusing position 160.

Sensing of the skewed positions 186, 186' of the belt 92 can be accomplished by any conventional means such as proximity or other sensors connected to the controller, ESS 26, and the dual function belt deskewing and oiling assembly. On the high speed belt fusing fixture, it has been observed that slight misalignments of the rollers cause the belt to mistrack. This invention takes advantage of this tracking tendency by controlling the alignment of the rollers.

By skewing the oiling roller 152 to steer the belt, the need for an additional tracking roller is eliminated. This reduces the number of parts necessary in the machine 8. Also, by eliminating an extra roller, the thermal load of the fusing apparatus 90 is reduced.

As can be seen, there has been provided an electrostatographic reproduction machine including a contact belt fusing apparatus for fusing copy sheets without belt skew defects. The fusing apparatus includes an endless fusing belt having an external fusing surface defining a path of movement and a plurality of support rollers for supporting and moving the endless fusing belt along the path of movement. The endless fusing belt as supported has a preferred fusing position properly aligned on the plurality of support rollers. The fusing apparatus includes a pressure roller forming a fusing nip with the external fusing surface of the endless fusing belt for contacting and moving toner image carrying sheets therethrough. Importantly, the fusing apparatus also includes a dual function belt deskewing and oiling assembly for oiling the external fusing surface of the endless fusing belt and deskewing the fusing belt from a sensed skewed position to the preferred fusing position. The dual function belt deskewing and oiling assembly includes an oiling roller for contacting and oiling the fusing belt, and skewing means for skewing the oiling roller to controllably move the endless fusing belt in a deskewing manner from a sensed skewed position to the preferred fusing position, thereby preventing belt skew defects on fused copies.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A contact fusing apparatus for reducing belt skew defects on fused copies, the fusing apparatus comprising:

(a) an endless fusing belt having an external surface defining a path of movement;

(b) a plurality of support rollers for supporting and moving said endless fusing belt along said path of movement and means for sensing belt skew, said endless fusing belt as supported having a preferred fusing position properly aligned on said plurality of support rollers, and an occasional undesirable sensed skewed position relative to said preferred fusing position;

(c) a pressure roller forming a fusing nip with said external surface of said endless fusing belt for contacting and moving therethrough toner image carrying sheets; and (d) a dual function belt deskewing and oiling assembly for oiling said external fusing surface of said endless fusing belt and deskewing said fusing belt from said sensed skewed position to said preferred fusing position, thereby preventing belt skew defects on fused copies.

2. The fusing apparatus of claim 1, wherein rollers comprising said plurality of support rollers have parallel axes.

3. The fusing apparatus of claim 1, wherein rollers comprising said plurality of rollers are mounted into contact with an inner surface of said endless fusing belt.

4. The fusing apparatus of claim 1, wherein said dual function belt deskewing and oiling assembly includes an oiling roller for contacting and oiling said fusing belt, and skewing means for skewing the oiling roller to controllably move the endless fusing belt in a deskewing manner from a sensed skewed position to the preferred fusing position.

5. The fusing apparatus of claim 2, wherein said dual function belt deskewing and oiling assembly includes an oiling roller and skewing means for skewing said oiling roller, relative to said parallel axes of said plurality of rollers, to controllably move said endless fusing belt in a deskewing manner from said sensed skewed position to said preferred fusing position.

6. The fusing apparatus of claim 5, wherein said skewing means are connected to a first end of said oiling roller.

7. The fusing apparatus of claim 6, wherein said dual function belt deskewing and oiling assembly includes a pivot means located at a second and opposite end of said oiling roller for enabling pivoting of said oiling roller when being skewed.

8. An electrostatographic reproduction machine for producing copy sheets without belt skew defects, comprising:

(a) means including a movable image bearing member, for forming and transferring a toner image onto a substrate; and (b) a fusing apparatus for reducing belt skew defects on fused copies, the fusing apparatus including:

(i) an endless fusing belt having an external surface defining a path of movement;

(ii) a plurality of support rollers for supporting and moving said endless fusing belt along said path of movement and means for sensing belt skew, said endless fusing belt as supported having a preferred fusing position properly aligned on said plurality of support rollers, and an occasional undesirable sensed skewed position relative to said preferred fusing position;

(iii) a pressure roller forming a fusing nip with said external surface of said endless fusing belt for contacting and moving therethrough toner image carrying sheets; and (iv) a dual function belt deskewing and oiling assembly for oiling said external fusing surface of said endless fusing belt and deskewing said fusing belt from said sensed skewed position to said preferred fusing position, thereby preventing belt skew defects on fused copies.

* * * * *